US007013766B2

(12) United States Patent
Lee

(10) Patent No.: US 7,013,766 B2
(45) Date of Patent: Mar. 21, 2006

(54) EXTENSION STRUCTURE FOR TOOL

(75) Inventor: Tian-Ming Lee, Taichung (TW)

(73) Assignee: Chuck Chang, Taichung (TW)

( * ) Notice: Subject to any disclaimer, the term of this patent is extended or adjusted under 35 U.S.C. 154(b) by 70 days.

(21) Appl. No.: 10/797,093

(22) Filed: Mar. 11, 2004

(65) Prior Publication Data

US 2004/0173060 A1 Sep. 9, 2004

Related U.S. Application Data

(63) Continuation-in-part of application No. 10/026,787, filed on Dec. 27, 2001, now abandoned.

(51) Int. Cl.
*B25B 13/00* (2006.01)

(52) U.S. Cl. ..... 81/177.85; 81/177.1; 81/177.2; 81/489; 403/325

(58) Field of Classification Search ..... 81/177.1, 81/177.2, 177.85, 489; 403/325, 365, 367
See application file for complete search history.

(56) References Cited

U.S. PATENT DOCUMENTS

| | | | | |
|---|---|---|---|---|
| 5,386,747 | A * | 2/1995 | Grover | 81/63 |
| 5,390,571 | A * | 2/1995 | Fox et al. | 81/177.85 |
| 5,531,140 | A * | 7/1996 | Chow | 81/177.85 |
| 6,003,414 | A * | 12/1999 | Hsieh | 81/177.85 |
| 6,199,457 | B1 * | 3/2001 | Hoff et al. | 81/177.85 |
| 6,327,941 | B1 * | 12/2001 | Cheng | 81/177.2 |
| 6,523,441 | B1 * | 2/2003 | Lee | 81/177.85 |

* cited by examiner

*Primary Examiner*—Lee D. Wilson
*Assistant Examiner*—Anthony Ojini
(74) *Attorney, Agent, or Firm*—Rosenberg, Klein & Lee

(57) ABSTRACT

An extension structure for a tool includes a main body, a drive rod movably mounted in the main body, an elastic member mounted in the main body and urged between the main body and the drive rod, and a rotation control member rotatably mounted on the main body and rested on the drive rod, so that the drive rod is moved in the main body by rotation of the rotation control member. Thus, the extension structure is assembled easily and quickly and has a rigid construction without detachment.

12 Claims, 6 Drawing Sheets

EXTENSION STRUCTURE FOR TOOL

CROSS-REFERENCES TO RELATED APPLICATIONS

The present invention is a continuation-in-part application of the co-pending U.S. Ser. No. 10/026,787, filed on Dec. 27, 2001 now abandoned.

BACKGROUND OF THE INVENTION

1. Field of the Invention

The present invention relates to an extension structure for a tool such as a wrench or the like, and more particularly to an extension structure which can be assembled easily and quickly and has a rigid construction.

2. Description of the Related Art

The closest prior art reference of which the applicant is aware is disclosed in the Taiwanese Patent Publication No. 88221334, entitled by "Main body of Wrench Extension", which disclosed a wrench extension including a main body, a push ring, and relative push and locking mechanisms. However, the structure of the wrench extension is complicated, and cannot be assembled easily, thereby causing inconvenience in assembly, and thereby increasing cost of fabrication.

Another prior art references are disclosed in the U.S. Pat. No. 6,199,457-B1, the U.S. Pat. No. 6,267,032-B1, and the U.S. Pat. No. 6,523,441-B2.

SUMMARY OF THE INVENTION

The primary objective of the present invention is to provide an extension structure which can be assembled easily and quickly, and has a rigid construction without detachment.

In accordance with the present invention, there is provided an extension structure, comprising:

a main body;

a drive rod movably mounted in the main body;

an elastic member mounted in the main body and urged between the main body and the drive rod; and a rotation control member rotatably mounted on the main body and rested on the drive rod, so that the drive rod is moved in the main body by rotation of the rotation control member.

Further benefits and advantages of the present invention will become apparent after a careful reading of the detailed description with appropriate reference to the accompanying drawings.

DETAILED DESCRIPTION OF THE INVENTION

Figure 1:
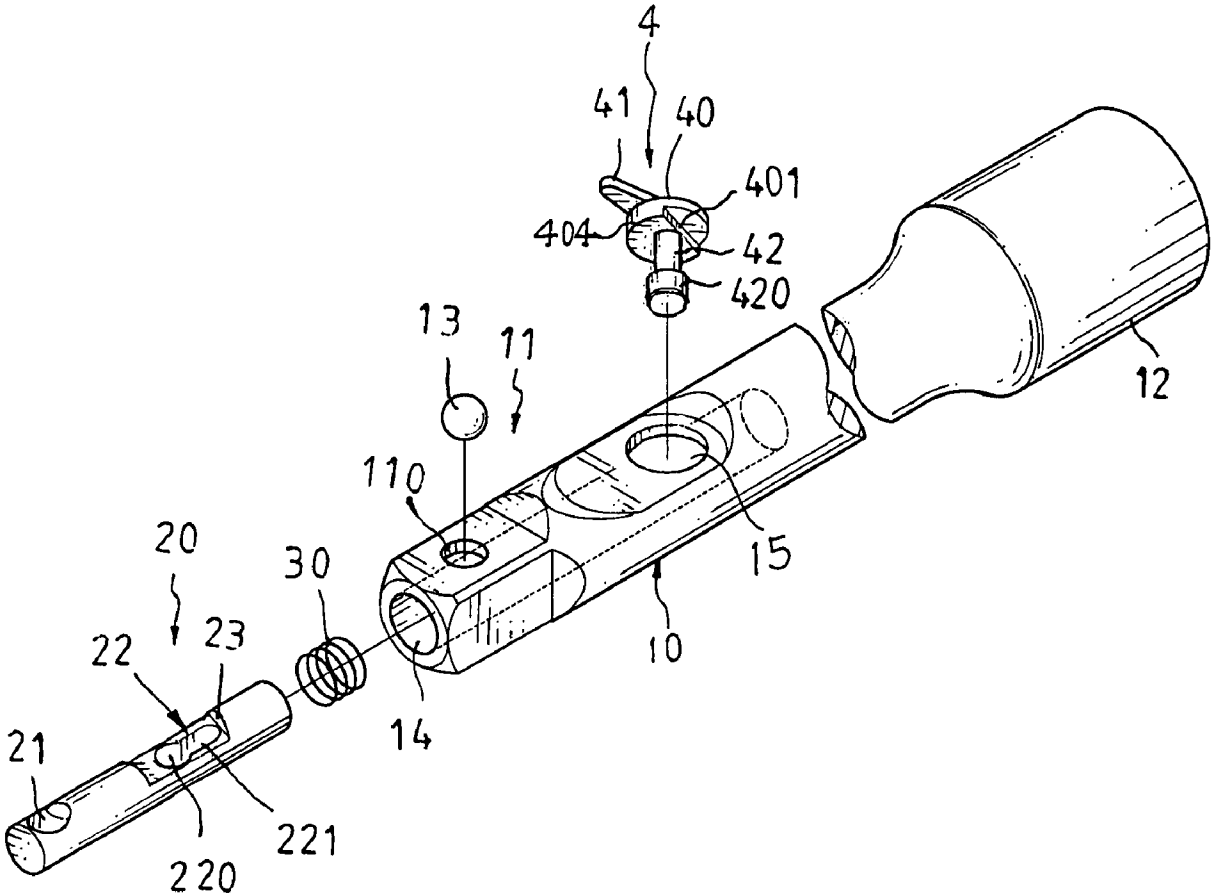
FIG. 1 is an exploded perspective view of an extension structure for a tool in accordance with the preferred embodiment of the present invention.

Referring to the drawings and initially to FIG. 1, an extension structure for a tool, such as a wrench or the like, in accordance with the preferred embodiment of the present invention comprises a main body 10, a drive rod 20 movably mounted in the main body 10, an elastic member 30 mounted in the main body 10 and urged between the main body 10 and the drive rod 20, and a rotation control member 4 rotatably mounted on the main body 10 and rested on the drive rod 20, so that the drive rod 20 is moved in the main body 10 by rotation of the rotation control member 4.

The main body 10 has an elongated cylindrical shape and has an inside formed with an elongated receiving chamber 14 extended in an axial direction of the main body 10. The main body 10 has a first end formed with a rectangular locking end 11 and a second end formed with a mounting portion 12. The locking end 11 of the main body 10 has a peripheral wall formed with a ball receiving hole 110 communicating with the receiving chamber 14, and a locking ball 13 is movably mounted in the ball receiving hole 110. The main body 10 has a mediate portion having a peripheral wall formed with a circular shaft hole 15 communicated with the receiving chamber 14. The shaft hole 15 of the main body 10 is extended into the receiving chamber 14 and has a side formed with a recessed closed wall 150 (see FIG. 3).

The drive rod 20 is movably mounted in the receiving chamber 14 of the main body 10. The drive rod 20 has a first end formed with an arcuate push recess 21 that is movable to align with the ball receiving hole 110 of the main body 10 for receiving the locking ball 13. The drive rod 20 has a second end formed with an operation slot 22 aligning with the shaft hole 15 of the main body 10.

Figure 3:
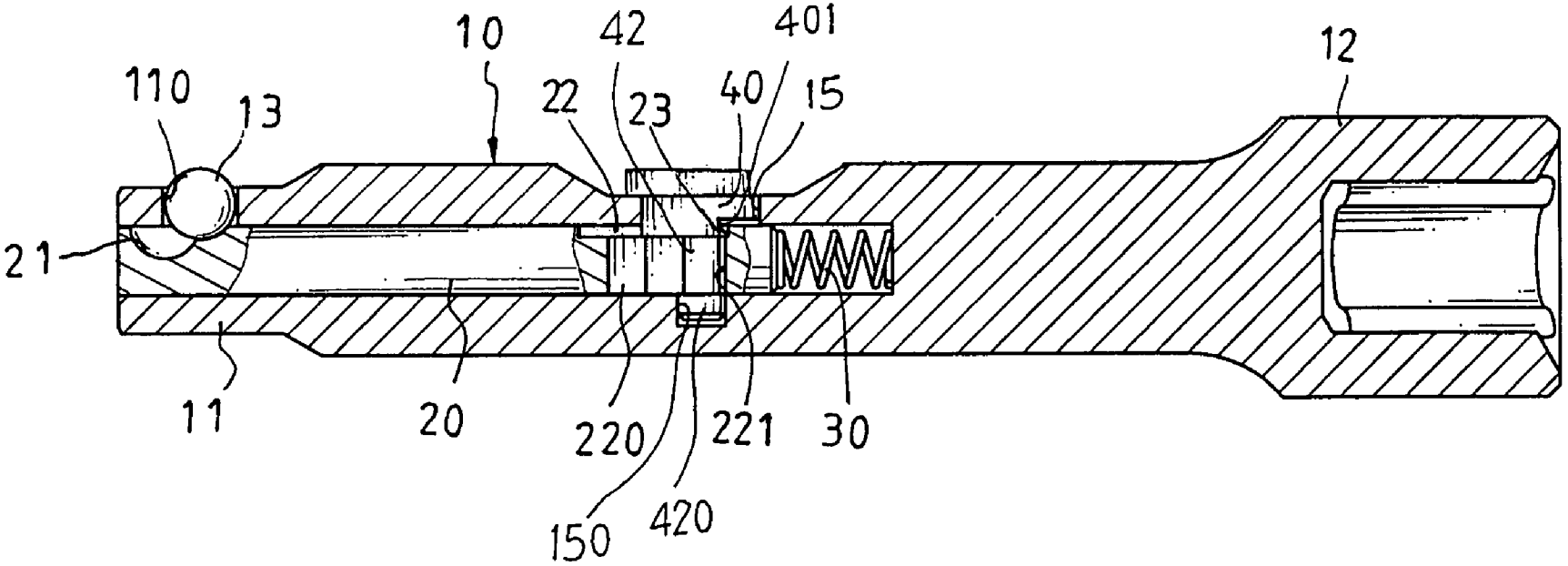
FIG. 3 is a front plan cross-sectional assembly view of the extension structure as shown in FIG. 1.

The rotation control member 4 includes a circular rotation body 40 rotatably mounted in the shaft hole 15 of the main body 10, a knob 41 mounted on a first side of the rotation body 40 and protruded outward from the main body 10, a circular drive section 42 mounted on a second side of the rotation body 40 and received in the operation slot 22 of the drive rod 20, and a circular enlarged head 420 mounted on a distal end of the drive section 42 and protruded outward from and rested on a peripheral wall of the drive rod 20. Preferably, the enlarged head 420 of the rotation control member 4 is rotatably mounted in the closed wall 150 of the shaft hole 15 of the main body 10 as shown in FIG. 3. Preferably, the enlarged head 420 of the rotation control member 4 has a diameter greater than that of the drive section 42.

The operation slot 22 of the drive rod 20 has the shape of a keyhole, and has a first end formed with a passage portion 220 having a diameter greater than that of the enlarged head 420 of the rotation control member 4 and a second formed with a positioning portion 221 having a width smaller than the diameter of the passage portion 220 and equal to the diameter of the drive section 42 of the rotation control member 4.

In addition, the rotation body 40 of the rotation control member 4 formed with a recessed oblique guide face 401, and the operation slot 22 of the drive rod 20 has a distal end formed with an oblique guide edge 23 rested on the guide face 401 of the rotation control member 4. Thus, the rotation body 40 of the rotation control member 4 is rotatable between a first position where the guide face 401 of the rotation body 40 is aligned with and rested on the guide edge 23 of the drive rod 20 and a second position where the peripheral wall 404 of the rotation body 40 is aligned with and rested on the guide edge 23 of the drive rod 20 to move the drive rod 20. In such a manner, the drive rod 20 is moved by rotation of the rotation body 40 of the rotation control member 4.

The receiving chamber 14 of the main body 10 has a distal end formed with a closed wall. The elastic member 30 is mounted in the receiving chamber 14 of the main body 10 and is biased between the closed wall of the receiving chamber 14 and the second end of the drive rod 20.

Figure 2:
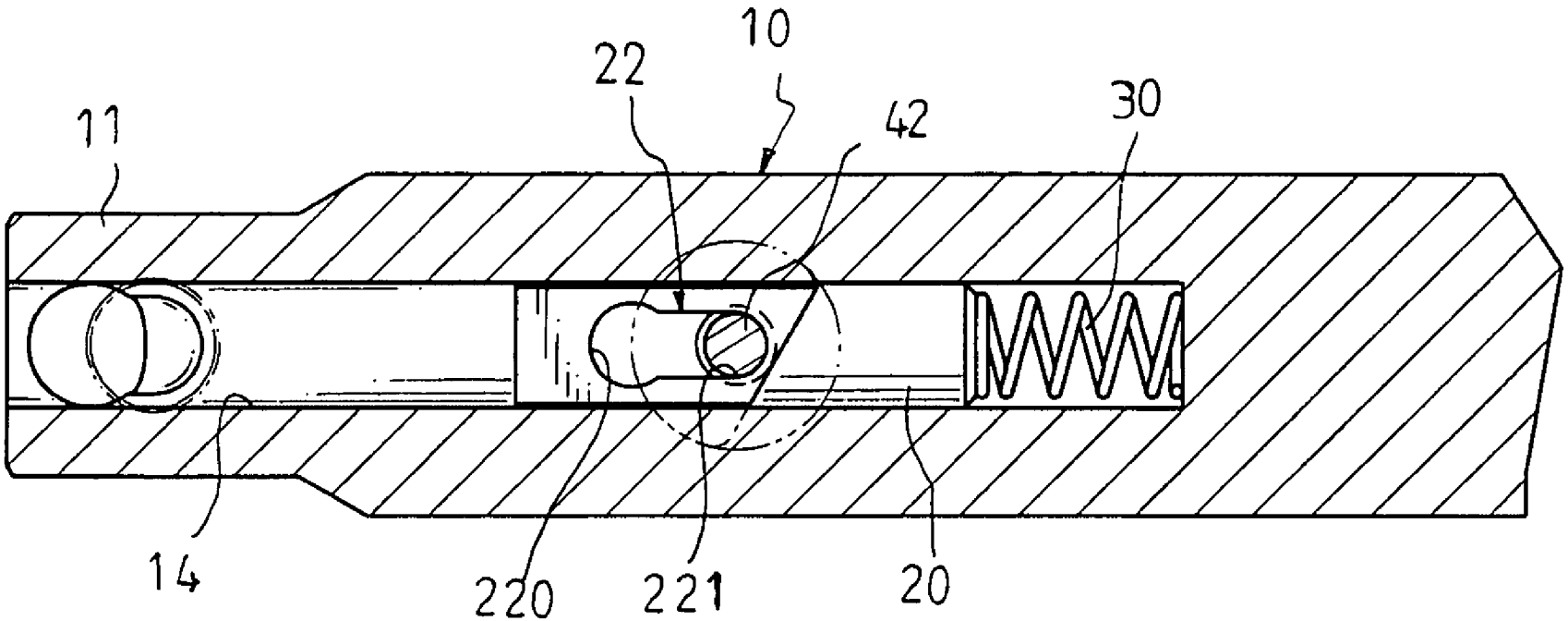
FIG. 2 is a partially cut-away top plan cross-sectional assembly view of the extension structure as shown in FIG. 1.

In assembly, referring to FIGS. 1–6, the drive rod 20 is pressed to retract into the receiving chamber 14 of the main body 10 to compress the elastic member 30 until the operation slot 22 of the drive rod 20 aligns with the shaft hole 15 and the passage portion 220 of the operation slot 22 aligns with the enlarged head 420 of the rotation control member 4. Then, the enlarged head 420 of the rotation control member 4 is passed through the shaft hole 15 of the main body 10 and the passage portion 220 of the operation slot 22 and inserted into the recessed closed wall 150 of the shaft hole 15 as shown in FIG. 3. At the same time, the drive section 42 of the rotation control member 4 is extended through the passage portion 220 of the operation slot 22, and the rotation body 40 of the rotation control member 4 is mounted in the shaft hole 15 of the main body 10. Then, the rotation body 40 of the rotation control member 4 is rotated in the shaft hole 15 of the main body 10 until the guide face 401 of the rotation body 40 is aligned with the guide edge 23 of the drive rod 20. At this time, the drive rod 20 is pushed by the elastic member 30 to move outward relative to the main body 10 and the rotation control member 4 until the guide face 401 of the rotation body 40 is rested on the guide edge 23 of the drive rod 20, so that the drive section 42 of the rotation control member 4 is inserted into the positioning portion 221 of the operation slot 22 as shown in FIG. 2 and the enlarged head 420 of the rotation control member 4 is rested on the peripheral wall of the drive rod 20. Thus, the rotation control member 4 and the drive rod 20 are combined with each other integrally and cannot be separated from each other. In addition, the drive section 42 of the rotation control member 4 is slidable in the positioning portion 221 of the operation slot 22 without detachment by restriction of the enlarged head 420 of the rotation control member 4. At the same time, the locking ball 13 is pushed by the push recess 21 of the drive rod 20 to protrude outward from the ball receiving hole 110 of the main body 10 as shown in FIG. 3.

Accordingly, the extension structure for a tool such in accordance with the present invention is assembled easily and quickly, and has a rigid construction without detachment.

Figure 4:
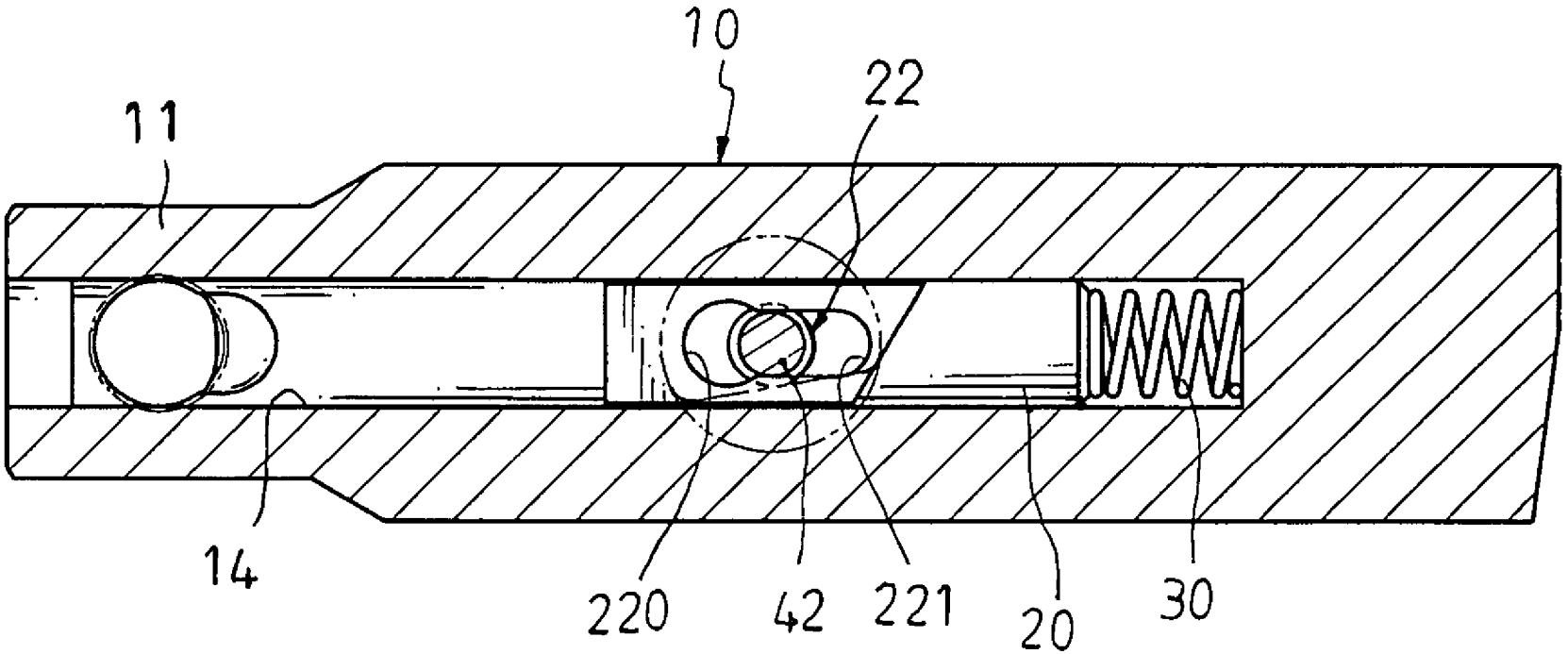
FIG. 4 is a schematic operational view of the extension structure as shown in FIG. 2.
Figure 5:
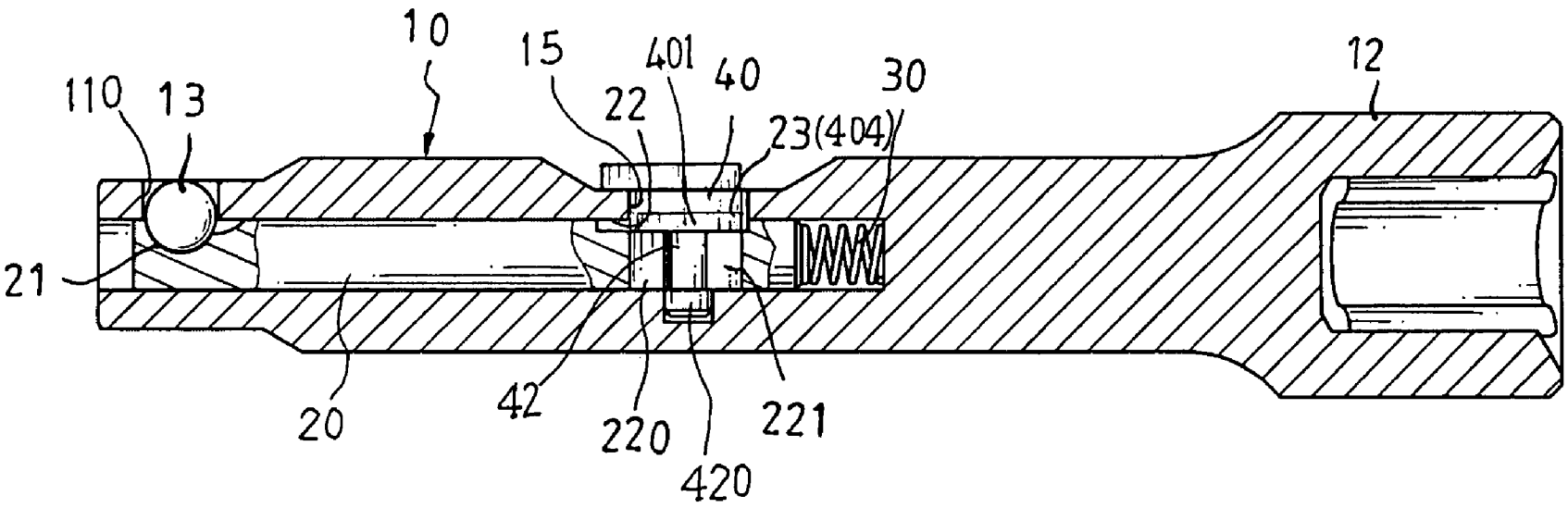
FIG. 5 is a schematic operational view of the extension structure as shown in FIG. 3.
Figure 6:
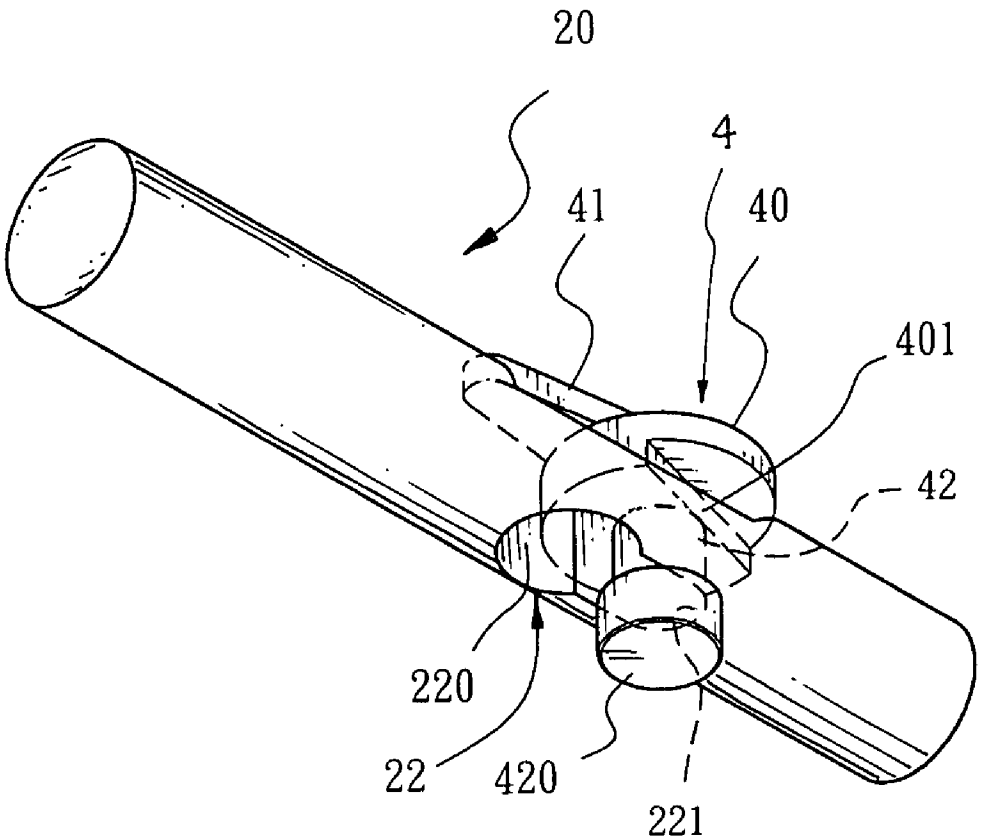
FIG. 6 is a partially perspective assembly view of the extension structure in accordance with the preferred embodiment of the present invention.

In operation, referring to FIGS. 1–6, the guide edge 23 of the drive rod 20 is initially rested on the guide face 401 of the rotation body 40, and the locking ball 13 is pushed by the push recess 21 of the drive rod 20 to protrude outward from the ball receiving hole 110 of the main body 10 as shown in FIG. 3. Then, the rotation body 40 of the rotation control member 4 is rotated by the knob 41 to separate the guide edge 23 of the drive rod 20 from the guide face 401 of the rotation body 40, so that the peripheral wall 404 of the rotation body 40 is urged on the guide edge 23 of the drive rod 20 to move the drive rod 20 toward the main body 10 and the rotation control member 4 to compress the elastic member 30. In such a manner, the push recess 21 of the drive rod 20 is moved to align with the ball receiving hole 110 of the main body 10, so that the locking ball 13 is retracted into the push recess 21 of the drive rod 20 and is retracted inward from the ball receiving hole 110 of the main body 10 as shown in FIG. 5. At this time, the drive section 42 of the rotation control member 4 slides in the positioning portion 221 of the operation slot 22 as shown in FIG. 4.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An extension structure, comprising:

a main body, the main body having a receiving chamber formed therein and a circular shaft hole formed though a peripheral wall thereof in open communication with the receiving chamber;

a drive rod movably mounted in the receiving chamber of the main body and having an operation slot formed in an end portion thereof and disposed in aligned relation with the shaft hole of the main body, the drive rod having an oblique guide edge formed on a distal end of the operation slot;

an elastic member mounted in the main body and urged between the main body and the drive rod; and a rotation control member rotatably mounted in the shaft hole of the main body and rested on the drive rod, so that the drive rod is moved in the main body responsive to rotation of the rotation control member; said rotation control member including:

a rotation body rotatably mounted in the shaft hole of the main body, the rotation body being formed with a recessed oblique guide face on one portion thereof disposed contiguous the oblique guide edge in a first position of the rotation control member and an arcuate peripheral wall on a remaining portion thereof, the rotation body being rotatable between the first position and a second position where the peripheral wall of the rotation body rests on the guide edge of the drive rod and thereby cams the drive rod to move distally, a knob coupled to a top side of the rotation body and extending outwardly from the main body, a circular drive section formed on a bottom side of the rotation body and received in the operation slot of the drive rod, and a circular enlarged head formed on a distal end of the drive section and extending outwardly from a peripheral wall of the drive rod and having a portion thereof in contact with the drive rod.

2. The extension structure in accordance with claim 1, wherein the shaft hole of the main body is extended into the receiving chamber and has a side formed with a recessed closed wall, and the enlarged head of the rotation control member is rotatably mounted in the closed wall of the shaft hole of the main body.

3. The extension structure in accordance with claim 1, wherein the enlarged head of the rotation control member has a diameter greater than that of the drive section.

4. The extension structure in accordance with claim 1, wherein the operation slot of the drive rod has a shape of a keyhole.

5. The extension structure in accordance with claim 1, wherein the operation slot of the drive rod has a first end formed with a passage portion and a second end formed with a positioning portion, and the drive section of the rotation control member is extended through the passage portion of the operation slot and inserted into the positioning portion of the operation slot.

6. The extension structure in accordance with claim 5, wherein the passage portion of the operation slot has a diameter greater than that of the enlarged head of the rotation control member.

7. The extension structure in accordance with claim 5, wherein the positioning portion of the operation slot has a width smaller than the diameter of the passage portion.

8. The extension structure in accordance with claim 5, wherein the positioning portion of the operation slot had a width equal to the diameter of the drive section of the rotation control member.

9. The extension structure in accordance with claim 5, wherein the drive section of the rotation control member is slidable in the positioning portion of the operation slot by restriction of the enlarged head of the rotation control member.

10. The extension structure in accordance with claim 1 wherein the receiving chamber of the main body has a distal end formed with a closed wall, and the elastic member is mounted in the receiving chamber of the main body and is biased between the closed wall of the receiving chamber and the second end of the drive rod.

11. The extension structure in accordance with claim 1, wherein the main body has an end formed with a rectangular locking end having a peripheral wall formed with a ball receiving hole communicating with the receiving chamber, and a locking ball is movably mounted in the ball receiving hole.

12. The extension structure in accordance with claim 11, wherein the drive rod has the other end formed with an arcuate push recess that is movable to align with the ball receiving hole of the main body for receiving the locking ball.

* * * * *